United States Patent [19]

Rounds

[11] 4,040,819

[45] Aug. 9, 1977

[54] BASIC OXYGEN STEEL FURNACE AND PROCESS

[76] Inventor: Gerald L. Rounds, Box 1074, Fontana, Calif. 92335

[21] Appl. No.: 712,352

[22] Filed: Aug. 6, 1976

[51] Int. Cl.[2] ..... C21C 5/38

[52] U.S. Cl. ..... 75/60; 75/59

[58] Field of Search ..... 75/59, 60

[56] References Cited

U.S. PATENT DOCUMENTS

| | | | |
|---|---|---|---|
| 3,186,831 | 6/1965 | Pike | 75/60 |
| 3,617,043 | 11/1971 | Hirao | 75/60 |
| 3,655,361 | 4/1972 | Brown | 75/60 |
| 3,799,763 | 3/1974 | Dortenzo | 75/60 |
| 3,960,546 | 6/1976 | Rote | 75/60 |
| 3,970,446 | 7/1976 | Kolb | 75/60 |

*Primary Examiner*—Peter D. Rosenberg

[57] ABSTRACT

An improved method for the production of steel which results in reducing the volume of off-flow gases which are created in the production of steel by the Basic Oxygen Steel Process. The method involves introduction of oxygen within the flame cone of the off-flow gases, above the opening of the furnace, resulting in oxidation of carbon monoxide to carbon dioxide. Turbulence of the off-flow gases is created through the further introduction of steam or air into the flame cone of the off-flow gases, which results in improvement of the rate of oxidation of the carbon monoxide.

6 Claims, 4 Drawing Figures

FIG. 1
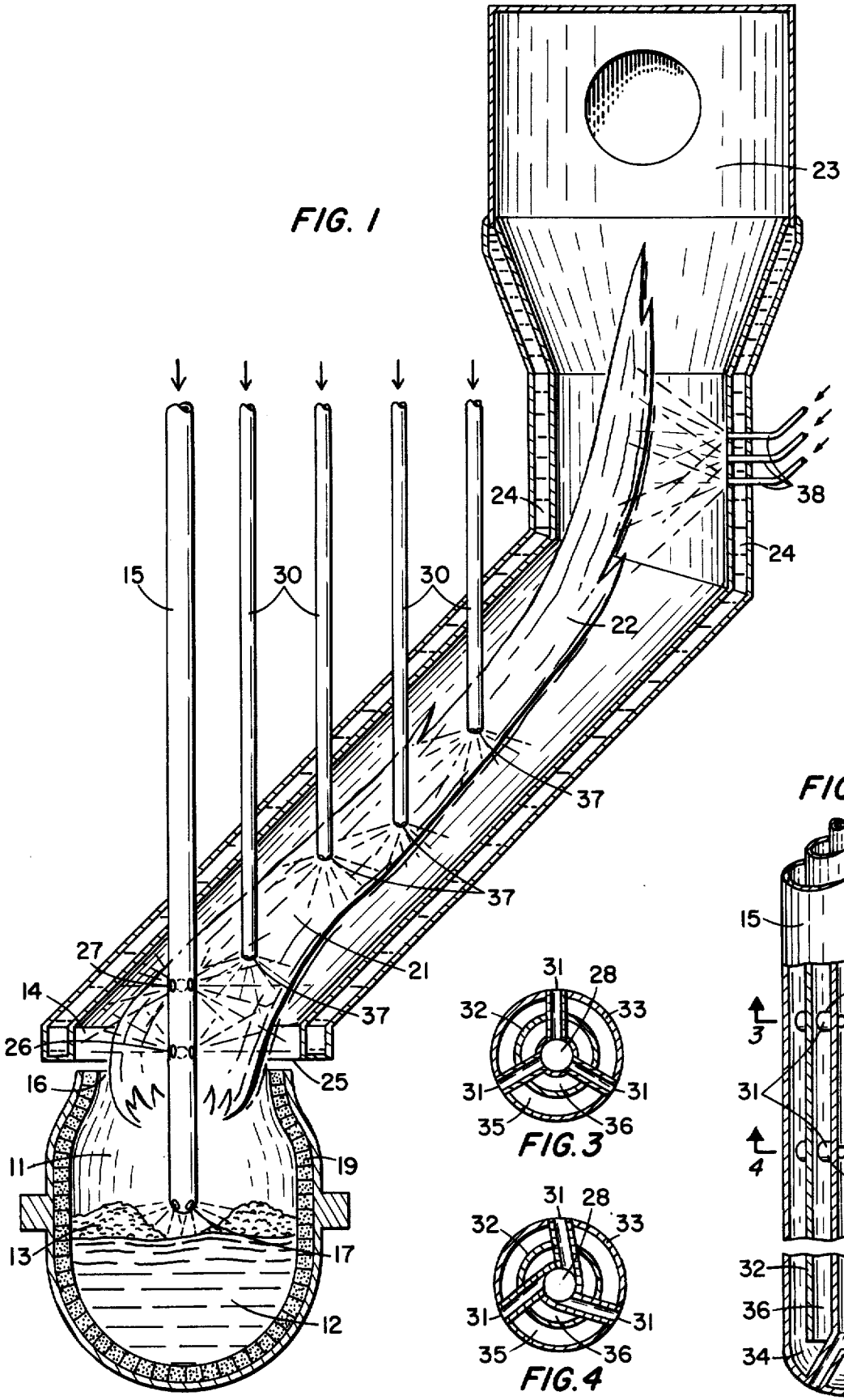
FIG. 2
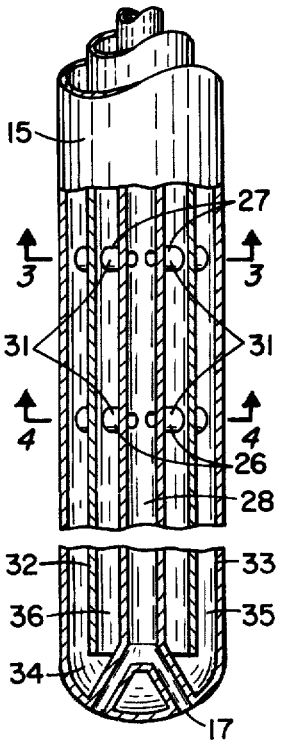
FIG. 3
FIG. 4

BASIC OXYGEN STEEL FURNACE AND PROCESS

BACKGROUND OF THE INVENTION

1. Field of the Invention

This invention relates to a method for reducing the volume of off-flow gases created in the production of steel by the Basic Oxygen Steel Process. The making of steel using the Basic Oxygen Steel Process involves the use, typically, of a furnace or vessel of a size that can hold between fifty and four hundred tons of steel. Initially the furnace is prepared with a molten metal charge, e.g., pig iron, which contains impurities of one to five percent. Additionally, cold or scrap metal is conventionally added to the furnace, followed by slag-forming material which forms a layer covering the surface of the metal charge.

Operation of the Basic Oxygen Steel Process results in reduction of the amount of carbon impurities within the metal charge to a level which is satisfactory for the desired steel. The amount of these carbon impurities is reduced by introducing oxygen into the furnace and allowing it to react with the carbon to form carbon monoxide and carbon dioxide. The introduction of this oxygen is often effected by the lowering of a water-cooled oxygen lance into the oxygen furnace to a point just above the metal charge. Oxygen is then blown through the lance at a relatively high rate which results in a blowing aside a portion of the slag layer, thereby allowing the oxygen to interact directly with the metal charge.

The reaction of carbon and oxygen to form carbon monoxide and carbon dioxide is exothermic, generating large amounts of heat energy, and in the Basic Oxygen Process is manifested by a large flame cone which contains carbon monoxide, carbon dioxide, dust particles and other impurities which escape through the opening of the furnace at extremely high temperatures as off-flow gases. While this process for making steel is very efficient and has supplanted, and is continuing to supplant, conventional open-hearth furnaces, the amount and character of the off-flow gases is a cause of concern, and because of the present environmental requirements, substantial effort is being expended to properly control these off-flow gases. Presently, methods are being used to confine the off-flow gases and treat them in a manner that reduces their toxicity to a point compatible with the environment, as by oxidizing the carbon monoxide to carbon dioxide for later release into the atmosphere, where air is used as the oxidizing medium.

2. Brief Description of the Prior Art to

Use of the Basic Oxygen Steel Process in facilities which do not provide for the collection of these off-flow gases, or do not flare the off-flow gases, require a large exhaust system to handle the large volume of these off-flow gases. Typically, these off-flow gases are emitted from the furnace at extremely high temperatures and with relatively high concentrations of carbon monoxide. The conventional exhaust systems include a large exhaust fan fo draw the off-flow gases into and through the exhaust system and draw in large amounts of air, thus facilitating oxidation of the carbon monoxide to carbon dioxide, as well as cooling the off-flow gases.

In a representative embodiment of the Basic Oxygen Steel Process, 12,500 standard cubic feet per minute (SCFM) of oxygen is needed to oxidize the carbon monoxide produced from a 100 ton oxygen furnace which contains 30% scrap and 70% hot metal charge with a 4% carbon impurity content. In a system of this nature, approximately 13,100% SCFM of carbon monoxide, 1,540 SCFM of carbon dioxide and 760 SCFM of other miscellaneous gases such as argon, $N_2$, and $SO_2$, are generated. Further, the exhaust system draws air in through the gap between the exhaust hood and the opening of the oxygen furnace in amounts of approximately 121,850 SCFM, this volume of air varying, depending upon the amount of cooling necessary and the exact configuration of equipment used within the exhaust system.

The final volume of gas which must by collected by the exhaust system in the above representative embodiment, is on the order of 202,000 SCFM, which is comprised of:

- 13,100 SCFM of carbon monoxide oxidized to carbon dioxide
- 1,540 SCFM carbon dioxide from the initial oxidation
- 760 SCFM of miscellaneous gases
- 116,300 SCFM of air drawn in by the exhaust system (5,550 SCFM of the oxygen within the air is used to oxidize the carbon monoxide)
- 70,300 SCFM of cooling water.

That amount of cooling water is required to lower is temperature of the off-flow gases so that they can by appropriately handled by the environmental conditioning equipment within the exhaust system, and the large amount of air required by the exhaust system is due, in part, to the fact that approximately 78% of air is nitrogen, and not relevant to the oxidation process.

SUMMARY OF THE INVENTION

This invention relates to an improved method for the production of steel which results in reducing the volume of off-flow gases which are created in the production of steel by the Basic Oxygen Steel Process. This method calls for the introduction of oxygen into the off-flow gases at a level above the opening of the furnace, to oxidize the carbon monoxide within the off-flow gases to carbon dioxide, and results in a significant reduction of the amount of gases which the exhaust system is required to handle. Because the introduced oxygen provides all the oxygen necessary to oxidize the carbon monoxide to carbon dioxide, the exhaust hoods can be lowered around the opening in the top furnace to reduce or eliminate the intake air.

It is an object of this invention to provide an Improved Basic Oxygen Steel Process which results in a reduced volume of off-flow gases so that the size of the air-handling equipment within the exhaust system can be reduced. A further object of this invention is to provide a method for reducing the volume of off-flow gases and reduce the volume of air drawn into the exhaust hood by the exhaust system. A further object of this invention is to provide a method for oxidation of carbon monoxide without causing excessive wear on the lining of the oxygen furnace.

BRIEF DESCRIPTION OF THE DRAWINGS

FIG. 1 is a cross-sectional view of a Basic Oxygen Steel Process showing the off-flow gases being drawn into the exhaust system.

FIG. 2 is a partial vertical cross section of the oxygen lance component.

FIG. 3 is a horizontal cross section of the oxygen lance taken at approximately 3—3 of FIG. 2.

FIG. 4 is a horizontal cross section of the oxygen lance taken at approximately 4—4 of FIG. 2.

DESCRIPTION OF THE PREFERRED EMBODIMENT

FIG. 1 shows the operation of the Basic Oxygen Steel Process as seen functionally in partial section. An oxygen furnace 11 contains a molten metal charge 12 and a layer of slag 13. Positioned immediately over the oxygen furnace 11 is an exhaust hood 14. An oxygen lance 15 projects through the mouth 16 of the oxygen furnace 11. The oxygen lance 15 is lowered through the exhaust hood 14 to a point immediately above the molten metal charge 12 so that when oxygen is blown through the oxygen lance 15 the slag 13 is pushed or blown out of the way allowing oxygen to interact directly with the metal charge 12.

The oxygen which is blown through the lower openings 17 in the bottom of the oxygen lance 15 interacts with the carbon impurities within the metal charge 12 to form carbon monoxide and carbon dioxide. This exothermic reaction generates substantial amounts of energy in the form of heat and increases the temperature within the oxygen furnace 11.

The reaction within the oxygen furnace 11 is extremely violent and large volumes of off-flow gases 21 escape through the mouth 16 of the oxygen furnace 11 in the form of a large flame cone 22.

The exhaust system 23 which includes an exhaust hood 14 that is lowered over the mouth 16 of the oxygen furnace 11, draws the off-flow gases 21 through the exhaust hood 14 for subsequent environmental conditioning. Exhaust hood 14, which is constructed so that water can be circulated through a jacket 24 within the exhaust hood 14 to prevent the extreme temperatures from destroying it, fits around the mouth 16 of the oxygen furnace 11 so that limited or restricted amounts of air can be drawn through the gap 25 between the mouth 16 of oxygen furnace 11 and the exhaust hood 14. In other embodiments of this invention the exhaust hood 14 may physically engage the mouth 16 of the oxygen furnace 11 so that no gap 25 exists and, consequently, no, or very little, air is drawn into the exhaust system 23.

The carbon monoxide within the off-flow gases 21 is oxidized to form carbon dioxide through the introduction of oxygen into the flame cone 22 of the off-flow gases 21 at a location above the mouth 16 of the oxygen furnace 11. This oxygen is introduced through upper ports 26 in the oxygen lance 15. Additionally, higher levels of upper ports 27 are provided to enable the further introduction of oxygen at a location higher in the exhaust hood 14. Because this introduced oxygen oxidizes essentially all the carbon monoxide within the off-flow gases 21, the necessity for the exhaust system 23 to draw in large quantities of air through the gap 25, as previously used for the reduction of carbon monoxide, is eliminated.

FIG. 2 shows broken section of the oxygen lance 15. The oxygen lance 15 comprises three concentric, cylindrical pipes as shown. The innermost pipe 28 is used to transport oxygen and communicates with lower opening 17 at the bottom of the oxygen lance 15. Upper ports 26 and higher upper ports 27 are provided at locations higher on the oxygen lance 15, these locations being determined so that, when the oxygen lance 15 is lowered to an appropriate point within the oxygen furnace 11, the upper ports 26 and the higher upper ports 27 are positioned within the flame cone 22 of the off-flow gases 21 above the mouth 16 of the furnace 11.

The upper ports 26 provide a means for the oxygen being transported through the innermost pipe 28 to be expelled from the oxygen lance at the desired locations through escape vents 31. The same concept prevails for the higher upper ports 27. Within the oxygen lance 15 a second pipe 32 is located between the innermost pipe 28 and the outer pipe 33. The outer pipe 33 and the second pipe 32 are constructed with a passage 34 at the bottom of the oxygen lance 15 which allows a cooling material to freely flow down the outermost annular chamber 35 through the passage 34 and return through the middle annular chamber 36. Generally the fluid which is used to cool the oxygen lance 15 is water. The direction of the flow of the coolant from the outer annular chamber 35 to the middle annular chamber 36, or alternatively, from the middle annular chamber 36 to the outer chamber 35 is immaterial.

FIG. 3 is a sectional diagram of the oxygen lance 15 taken at the higher upper ports 27. The particular configuration of the higher upper ports 27 are such that they allow the oxygen to escape from the innermost pipe 28 in a radial direction through the escape vents 31.

FIG. 4, alternatively, shows a section of the oxygen lance 15 taken at the upper ports 26. The particular orientation of escape vents 31 at the upper ports 26 is such that they allow the escape of oxygen from the innermost pipe 28 at an angle inclined to a line normal with the circumference of the oxygen lance 15. The various combinations of the particular orientation of the escape vents 31 within the oxygen lance 15, the particular location of the upper ports 26 and the higher upper ports 27, and the number of additional levels of upper ports provided within the oxygen lance 15 are considered to be within the scope of this invention.

Referring again to FIG. 1, additional provisions for the further introduction of oxygen, or alternatively, steam or air, are provided through a plurality of additional lances 30. The particular construction of the additional lances 30 is generally similar to that of the oxygen lance 15 in that they would provide an inner pipe for the tranportation of oxygen and a middle annular chamber and an outer annular chamber for the transportation of a coolant. Unlike the oxygen lance 15 which must be retractable, the additional lances 30 may be fixed or alternatively, may be retractable. The additional lances 30 are positioned so that the bottom openings 37 of the additional lances 30 are located at positions higher up within the flame cone 22 of the off-flow gases 21. Means are provided (not shown) which allow each of the additional lances 30 to transport either oxygen, steam, or air, as desired.

Selection of oxygen for transportation through an additional lance 30 would be due to a requirement for further oxidation of the carbon monoxide within the off-flow gases 21. Alternatively, steam could be used to create turbulence within the flame cone 22, in order to give the oxygen, presently within the off-flow gases 21, more opportunity to react with the carbon monoxide, and further, to provide a means for cooling the off-gases 21. Alternatively, the selection of air for transportation through the additional lance 30 would be due to a requirement for additional cooling of the off-gases 21, and also a need for additional oxygen for the further oxidation of the carbon monoxide.

A conceptual variation of the provisions for additional lances 30, which is within the scope of this invention, is a provision of vents or jets, which protrude through the exhaust hood 14, and allows a means for the introduction additional oxygen, steam or air.

Because the present method allows for the complete oxidation of the carbon monoxide component of the off-flow gases 21, the exhaust hood 14 can be lowered around the mouth 16 of the oxygen furnace 11 to restrict, or alternatively, to eliminate the ingress of air through the gap 25.

Due to the heat generated by the oxidation of carbon monoxide to carbon dioxide, the off-flow gases 21 must be cooled in order that they may be properly conditioned by the exhaust system 23. This cooling is accomplished by introducing water by means of suitable water-spraying devices 38 positioned higher up in the exhaust system 23.

This invention is applicable to other types of basic oxygen steelmaking processes wherein substantially the same type of fumes are generated and wherein extensive exhaust hood 14 and exhaust system 23 equipment are required. Examples of the processes are the Kaldo Process, as described in *The Kaldo Process,* Journal of the Iron and Steel Institute, Vol. 206, Pf. 10, 1966, Pages 997–1006, by Pearson, et al., and which involves a side-blown converter, and the bottom-blown oxygen converter process (Q-BOP) a typical example of which is disclosed in British Patent 1253581.

Although none of the latter oxygen steel processes and others that have been proposed seem to be destined to achieve the use and acceptance of the top-blown converter, the chemical reactions are essentially the same, i.e., the heat of the reaction is supplied by the oxygen combustion and massive quantities of carbon monoxide are generated in the refining of the steel as the carbon content of the hot metal is reduced. Therefore, they are deemed to be within the scope of this invention.

It is understood that the description herein of my invention is done to fully comply with requirements of 35 U.S.C. Section 112, and that is not intended to limit the invention in any way. Thus, variant forms of the herein-described method for reducing the volume of off-flow gases, within the concept of the present invention, could easily be developed. Such variant forms are considered to be within the scope and essence of this invention.

What is clamied is:

1. In a method of producing steel, of the type wherein oxygen is blown into a charge comprising molten metal and slag-forming components within a furnace, having a mouth, to generate the heat of reaction required to refine the metal, and wherein generated off-flow gases are removed from the furnace by passage through a hood above the mouth of the furnace, the improvement comprising the step of contacting the off-flow gases with oxygen by introducing a stream of substantially pure oxygen into the hood above the mouth of the furnace whereby to oxidize the carbon monoxide component of said off-flow gases to carbon dioxide.

2. The method of claim 1 wherein the introduction of oxygen into the off-flow gases is effected through ports in an oxygen lance which is lowered through the hood into substantially the center of the furnace above the molten metal and where said ports are positioned at a level above the mouth of the furnace.

3. The method of claim 1 wherein the off-flow gases are also contacted with a stream of air or steam to increase the turbulence of the gases within the hood.

4. The method of claim 1 wherein the introduction of oxygen into the off-flow gases is effected through ports in a plurality of lances positioned within said hood.

5. The method of claim 1 further comprising reducing the temperature of the off-flow gases by contacting the off-flow gases after they have been contacted with the oxygen stream, with a stream of water or steam.

6. The method of claim 1 wherein the hood engages the mouth of said furnace.

* * * * *